United States Patent [19]

Paraskevakos

[11] Patent Number: 4,708,341

[45] Date of Patent: Nov. 24, 1987

[54] ARCHERY/PRACTICE EXERCISE DEVICE AND ATTACHMENTS THEREFOR

[75] Inventor: Theodore G. Paraskevakos, Melbourne, Fla.

[73] Assignee: Indoor Archery International Corporation, Melbourne, Fla.

[21] Appl. No.: 927,513

[22] Filed: Nov. 6, 1986

Related U.S. Application Data

[62] Division of Ser. No. 584,880, Feb. 29, 1984, Pat. No. 4,623,145.

[51] Int. Cl.[4] ..... F41B 5/00

[52] U.S. Cl. ..... 272/135; 124/55; 124/67; 124/23 R; 124/24 R; 124/83; 124/88

[58] Field of Search ..... 273/310, 311, 312; 124/65, 67, 23 R, 86, 87, 88, 55, 24 R, 83; 272/135

[56] References Cited

U.S. PATENT DOCUMENTS

| | | | |
|---|---|---|---|
| 2,214,224 | 9/1940 | Douglas | 124/67 |
| 2,709,426 | 5/1955 | Nove | 124/21 |
| 3,762,222 | 10/1973 | Garot et al. | 124/23 R |
| 4,195,422 | 4/1980 | Budmiger | 273/310 |
| 4,261,321 | 4/1981 | Nishioka | 124/67 |
| 4,262,908 | 4/1981 | Budmiger | 273/310 |
| 4,640,258 | 2/1987 | Penny et al. | 124/89 |

FOREIGN PATENT DOCUMENTS

| | | | |
|---|---|---|---|
| 568468 | 10/1957 | Italy | 124/65 |
| 521449 | 3/1975 | U.S.S.R. | 124/87 |

*Primary Examiner*—Leo P. Picard

*Attorney, Agent, or Firm*—Antonelli, Terry & Wands

[57] ABSTRACT

An archery practice/exercise device for use with a bow including a handleriser portion and a bow string. The practice/exercise device includes a cylinder having a closure member for partially closing a forward end of the cylinder so as to delimit an orifice through which air may be expelled from the cylinder. A piston is mounted for movement within the cylinder and an arrow-like shaft having a forward end is coupled to the piston and extends outwardly from a rear end of the cylinder. A fastening arrangement is disposed proximate to the rear end of the cylinder and secured thereto for enabling rigid attachment of the cylinder to the handleriser of the bow whereupon attachment to the handleriser, the cylinder extends forwardly of the handleriser for stabilizing the bow. Upon an archer coupling nock to the bow string and drawing the arrow-like shaft out of the cylinder to a desired length, the piston is caused to move from an initial forward position to a rearward position within the cylinder, and upon the archer releasing the arrow-like shaft from the drawn-out position, the piston is driven forwardly compressing air within the cylinder and forcing the air out of the orifice so that a substantial portion of the energy of the bow is absorbed by the cylinder, thereby enabling the archer to exercise and practice archery skills in a safe manner without the shooting of a regular arrow.

14 Claims, 18 Drawing Figures

ARCHERY/PRACTICE EXERCISE DEVICE AND ATTACHMENTS THEREFOR

This is a division of application Ser. No. 584,880 filed Feb. 29, 1984, now U.S. Pat. No. 4,623,145.

BACKGROUND OF THE INVENTION

The present invention relates to an archery practice and exercise device as well as attachments therefor.

Known exercising methods or devices for archery generally consist of weightlifting, rubber or metal spring pulling, bow pulling without releasing an arrow and, of course, bow pulling and releasing of arrows. However, all manufacturers of bows strongly recommend against "dry firing" (which is the releasing of the string of the bow without shooting an arrow) because it can severly damage the bow and adversely affect the archer. Except for bow and arrow practice arrangements which require special facilities and safety precautions, presently existing devices do not permit an archer to draw, aim and release his bow without subjecting the same to damage.

Further, it is known in the art to utilize special bow arrangements or attachments to a bow for projecting missiles or the like. However, such known devices do not serve as exercise or practice devices. For example, U.S. Pat. No. 2,069,821 issued Feb. 9, 1937 and U.S. Pat. No. 2,214,224 issued Sept. 10, 1940, both to H. A. Douglas, disclose a missile projecting device utilizing a piston-cylinder type arrangement which is constructed as a part of a special, sole purpose bow. Such patents are directed to the construction of a weapon which is more efficient than a regular arrow and disclose a device formed as a part of the bow wherein the cylinder portion extends rearwardly of the handleriser of the bow. U.S. Pat. No. 2,757,657 issued Aug. 7, 1956 to H. H. Lohmeyer discloses another pellet projection device utilizing the energy of a piston-cylinder attachment to a bow for enhancing the power of a bow. In this patent, also, the cylinder portion extends rearwardly of the handleriser of the bow. U.S. Pat. No. 3,572,311 issued Mar. 23, 1971 to R. T. Baer discloses a device which extends rearwardly of the handleriser of a bow and provides for a permanent attachment of an impact head to the bow string. The impact head moves through a barrel for transferring the energy of the bow to a projectile so as to propel the projectile from the barrel. Since the projectile has a relatively small mass, the energy of the bow limbs (especially compound bows) which is not totally transferred to the projectile has to be absorbed by the bow itself with the danger of damage to the bow. U.S. Pat. No. 4,146,009 issued Mar. 27, 1979 to B. D. Adams discloses a device which is mounted rearwardly of the handleriser in the form of a barrel, and a carrier for movement through the barrel, wherein the string of the bow is attached permanently to the carrier and transfers energy of the bow to a projectile. Each of the aforementioned patents is directed to an arrangement for propelling projectiles or missiles from a bow with the purpose of enhancing the power of the bow. Additionally, U.S. Pat. No. 3,877,611 issued Apr. 15, 1975 to Morrison et al discloses a toy in the form of a water gun and bow arrangement which incorporates an elastic string attached to a bow-like structure and operates in the manner of a bow to project water or other liquid. While this patent utilizes a piston-cylinder arrangement, the major portion of the cylinder is disposed rearwardly of the handleriser of the bow. Thus, the aforementioned patents are not directed to archery practice or exercise devices and generally provide a permanent or semi-permanent connection with the bow structure with the device being located rearwardly of the handleriser of the bow and with the string of the bow being permanently attached thereto. As such, these devices are bulky, expensive to produce, difficult to use and impractical as an exercise and practice device.

SUMMARY OF THE INVENTION

It is, therefore, an object of the present invention to provide an archery practice and exercise device which is safe to use and which will not damage the bow in use.

It is another object of the present invention to provide an archery exercise and practice device having a piston-cylinder arrangement wherein the cylinder extends forwardly of the handleriser of the bow and serves as a stabilizer as well as a shock-absorbing mechanism.

It is another object of the present invention to provide an archery exercising and practice device which, when operated, enables air to be expelled therefrom and which is capable of receiving attachments responsive to the air for propelling missiles or projectiles or utilizing light responsive devices for game purposes.

In accordance with the present invention, an archery exercise and practice device is provided for attachment with a bow. The device comprises a cylinder having one end partially sealed so as to delimit an orifice permitting air to escape therefrom and a piston driven by an arrow-like shaft disposed within the cylinder for compressing air within the cylinder which compressed air escapes through the orifice and which cylinder serves for absorbing the energy of the piston. The cylinder attaches to the bow in the arrow rest position and the arrow-like shaft operates through the string of the bow, upon the draw and release of the arrow-like shaft, so that the cylinder serves as a shot-absorbing mechanism which converts the energy of the arrow-like shaft into heat and, at the same time, permits the compressed air in front of the piston to escape through the orifice of the cylinder.

According to a feature of the present invention, the energy of the bow is attenuated and absorbed so that the practice of archery is made safe and easily available and achievable irrespective of the lack of special facilities and safety precautions. That is, an archer can practice archery safely, without releasing a real arrow, because no projectile is thrown, if desired. No special facilities are required, such as archery lanes, special targets able to stop arrows without damage to the arrows, and no weather restrictions are encountered since archery which has been primarily an outdoor sport can be practiced indoors without losing, bending or breaking arrows, damaging the bow from dry firing or endangering lives by operating the bow in the vicinity of others. Moreover, the exercising and practice device is easily attached and detached from any bow on the market today with the cylinder extending forwardly of the handleriser so as to function as a stabilizer, a stabilizer being a weight attached to the bow for providing stability.

Additionally, in accordance with the present invention, the arrow is not permanently attached to the string so that the device can remain attached to the bow without interferring with the primary function of the bow, i.e., to shoot a regular arrow. With the piston-cylinder arrangement of the present invention, the archer makes the same muscle moves as in the shooting of a regular arrow including the drawing of the arrow and the release which is a very important archery skill. Thus, the present invention develops all the skills and muscles necessary for archery and enables an increase of the archer's stamina allowing the archer to use more aiming time and, in general, develops all the necessary archery skills. Accordingly, athletic clubs, institutions and archery teams can benefit from the use of the present invention.

In accordance with other features of the present invention, various attachments may be coupled to the cylinder to enable the propelling of BBs and air darts both indoors or outdoors in a safe manner so as to make the exercise and practice device more enjoyable since the present invention attenuates the force of the projectiles within a few meters from the archer. Additionally, the present invention provides for a T.V. game attachment or photo-target attachment for transmitting or receiving light beams indicative of the shooting of an arrow and which enable scores to be generated in accordance with the accuracy without requiring the propelling of a projectile.

These and further objects, features and advantages of the present invention will become more obvious from the following description when taken in connection with the accompanying drawings which show, for purposes of illustration only, several embodiments in accordance with the present invention.

DESCRIPTION OF THE PREFERRED EMBODIMENTS

Figure 1:
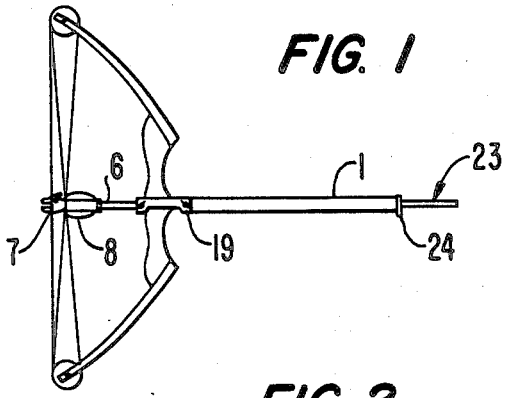
FIG. 1 is a side elevational view of the practice/exercise device of the present invention as attached to a bow.
Figure 2:
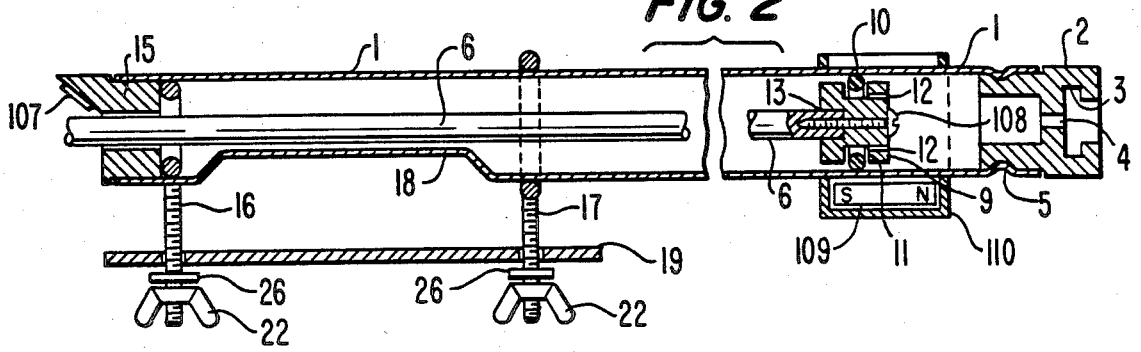
FIG. 2 is a partial sectional view of the piston-cylinder arrangement and the attaching mechanism

Referring now to the drawings wherein like reference numerals are utilized to designate like parts throughout the several views, FIG. 1 illustrates a side elevational view of the exercise device of the present invention as attached to a bow at its central portion or handleriser and extending forwardly therefrom. The exercise/practice device comprises a cylinder 1 detachably secured to the handleriser portion of the bow and extending forwardly therefrom. Thus, the cylinder 1 serves as a stabilizer for the bow. The cylinder 1 may be constructed from plastic or metal with the appropriate diameter which may be from $\frac{1}{4}$ to 2 inches. FIG. 2 is a partial sectional view of the cylinder and illustrates, for example, a $\frac{3}{4}$ inch diameter aluminum cylinder with the forward end of the cylinder 1 carrying a plug 2. The plug 2 may be constructed from metal or plastic and has a diameter corresponding to that of the cylinder 1. The plug 2 is provided with an attachment extension 3 which may be formed of a shape and size sufficient to accommodate attachments as described hereinafter. The attachment extension 3 may be in the form of a member having indentations such as a groove or channel and may be constructed integrally with the plug 2 and made of a same material or different material according to the application for which it is designed. As shown, the plug 2 is provided with a through opening or orifice 4 which permits air trapped within cylinder 1 to escape during the operation of the practice/exercise device as described hereinafter. The size of the orifice 4 depends on the size of the cylinder diameter and the force of the bow. For example, the orifice 4 with a $\frac{3}{4}$ inch diameter cylinder may be 0.010 inch. As shown, the plug 2 is provided with a circumferential groove or channel 5 which enables crimping of the cylinder 1 into the channel so as to securely mount the plug at the forward end of the cylinder. However, any other mounting, such as screwing, gluing, wedging, may be utilized in dependence upon the material and application.

Figure 3:
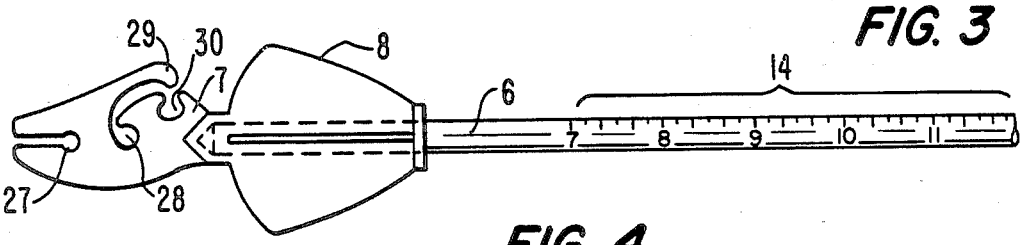
FIG. 3 illustrates the arrow end portion of the piston arrangement.
Figure 4:
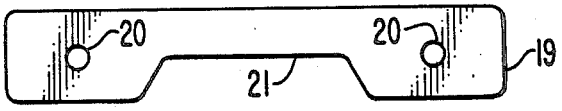
FIG. 4 illustrates the holding plate of the attachment device.

As shown in FIG. 2, disposed within the cylinder 1 is an arrow-like shaft 6 which may be constructed from metal, plastic, fiberglass, wood or any other suitable material according to the application. The arrow-like shaft is sized in accordance with the size of the cylinder 1 and the draw length of the archer. The rear end of the shaft, as illustrated in FIG. 3, is provided with a suitable nock 7 and a cosmetic (non-functional and optional) rubber fletching 8. The forward end of the arrow-like shaft 6 is provided with a piston 9 which is constructed from metal or plastic suitable for the application and having a diameter slightly smaller than the internal diameter of the cylinder 1. The piston 9 is provided with a circumferential groove or channel for receiving an "O" ring 10. The O ring 10 is sized so as to provide a sliding seal with the internal diameter of the cylinder 1. Depending upon the material of the O ring, the ring may require lubrication so as to maintain a tight fit with the cylinder. The piston 9 also is provided with at least one air channel 12 extending in the axial direction for communicating the space of the groove 11 with the area in front of the piston. The air channels 12 act as air valves to avoid the build-up of a vacuum during the draw of the shaft 6, i.e., when the shaft 6 is pulled in the rearward direction, if the orifice 4 of the plug 2 is closed by a projectile or any other member at the time. The arrow-like shaft 6 is received within a bore 13 of the piston and is securely attached thereat. As illustrated in FIG. 3, the arrow-like shaft 6 carries indentation marks 14 in inch or metric increments to indicate the draw length to the archer so that the archer can adjust his draw accordingly, it being noted that constant draw is a very important discipline for the archer. The arrow-like shaft 6 passes through a plug 15 provided at the rear end of the cylinder 1, which plug has the shape of a bushing and serves to center the arrow-like shaft 6 with respect to the cylinder as well as to permit free movement of the shaft into and out of the cylinder. The plug may be provided with a small mirror 107 mounted at a 45° angle on an upper plug surface extending outwardly from the cylinder 1. With this arrangement, the archer can easily view the marks 14 via the mirror 107 and adjust his draw accordingly.

Another arrangement for enabling the practice of a constant draw length is by the utilization of a sound box 110. The sound box may be in the form of a cylindrical member for slidable movement along the exterior of cylinder 1 and housing a small magnet 109 which is freely movable within the sound box. The sound box is positioned along the cylinder 1 at a point at which the piston 9 comes to an end position when the arrow-like shaft 6 is drawn out of the cylinder 1 to the desired extent corresponding to the desired draw length to be attained. As shown, the piston 9 is provided with a mounting screw 108 which may serve for mounting the arrow-like shaft to the piston. The screw 108 serves as a magnet attracting member and is formed of a ferrous material whereas the other components of the practice exercise device are formed of material which do not attract the magnet, e.g., non-ferrous materials. When the piston 9 and the screw 108 comes to a position across from the magnet 109, the magnet is attracted by the screw 108 and is drawn upwardly so as to hit the cylinder 1 producing a characteristic clicking noise. This noise therefore indicates that the desired draw length has been reached and to release the arrow-like shaft. Upon release of the arrow-like shaft, the piston 9 and the ferrous screw 108 is driven forwardly interrupting the magnetic attraction forces and the magnet 109 drops to the bottom of sound box 110 and is in position for another operation.

The cylinder 1 is attachable to any type of bow (long bow, recurve, compound, cam, etc.) through eye bolts 16 and 17 which may be fixedly secured to the exterior or interior of the cylinder while enabling free movement of the shaft 6 with the bolt portions extending therefrom. The cylinder 1 is also provided with an indentation 18 at its rear end portion for permitting the arrow-like shaft to be as close to the arrow rest as possible so that the shaft 6 is in alignment with the bow string. The cylinder is detachably secured to the bow by means of a plate 19, washers 26 and wing nuts 22, for example. As shown in FIG. 3, the fastening plate 19 which may be constructed from metal or plastic according to the application therefor, is provided with two holes 20 for receiving the eye bolt 16 and 17 therethrough. The plate 19 is also provided with an indentation or cut-out portion 21 for accommodating the arrow rest buttons, plungers, etc. which are provided on the more sophisticated bows. Consideration must be given in the case of metal construction of the plate 19 for the plate to be provided with bonded on plastic or any other suitable material to avoid scratching or damage of the bow to which it is fastened. Similar considerations must be given to the eye bolts 16 and 17 along with the indentation 18 of cylinder 1 with respect to scratching or damaging of the bow. As is apparent, the cylinder 1 may be detachably fastened to the bow by any suitable arrangement other than that illustrated.

As shown in FIG. 2, the nock 7 at the rear end of the shaft 6 may be provided with an indentation 27 to accommodate the bow string. If, for example, a heavier bow is utilized or a different type of indentation is desirable, the nock 7 is also provided with an indentation 28 which can retain the bow string in place upon receipt via the expansion indentation 29 and the receptacle indentation 30. As is apparent, the bow string may be coupled to the shaft 6 in any known manner. In operation, with the practice/exercise device attached to the bow in the manner illustrated in FIG. 1, the archer couples the bow string to the nock 7 and thereafter draws the arrow-like shaft 6 resulting in the shaft being drawn out of the cylinder 1 with the archer being able to measure the draw by means of viewing the marks 14 on the shaft via the mirror 107 or by hearing the noise provided by the sound box 110. The archer can aim the arrow-like shaft in the normal manner and upon attaining a desired aiming point releases the shaft whereby the bow string drives the shaft forwardly and the piston 9 is driven through the cylinder compressing the air within the cylinder which escapes through the orifice 4 formed in the end plug 2. At the same time the cylinder acts as a shot-absorbing mechanism converting the energy of the arrow-like shaft into heat in the orifice. Thus, the bow can be utilized in its normal manner and an archer can practice archery without releasing a real arrow in a safe manner without special facilities being required. Additionally, since the practice/exercise device permits the archer to make the same muscle movements required in the drawing and release of an arrow, the archer can develop the necessary muscles for archery as well as increasing the archer's stamina and developing all the necessary archery skills. Further, due to the manner of attachment of the cylinder and the extension thereof forwardly of the handleriser of the bow, the practice/exercise device also serves as a stabilizer for the bow.

Although the practice/exercise device as illustrated in FIGS. 1–4 only provides for the expulsion of air from the cylinder and does not propel a missile or other projectile toward a target, various attachments may be coupled with such device for propelling objects toward a target or for providing transmission or reception of light for target purposes. Thus, with the attachments to be discussed hereinafter, target shooting may be practiced indoors or outdoors safely since the objects propelled are not lethal and the practice/exercise device attenuates the forces of such objects so as to be effective only a few meters from the archer. Additionally, a TV game attachment or photo-target attachment does not propel any projectile or object, but rather utilizes the light responsive arrangements target shooting purposes.

Figure 6:
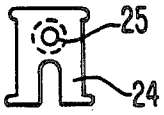
FIG. 6 is an end view of the BB attachment of FIG. 5.
Figure 5:
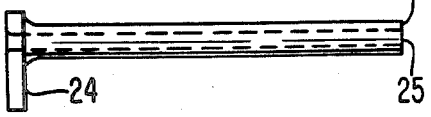
FIG. 5 is a side elevational view of a BB attachment for the practice/exercise device.

FIGS. 5 and 6 illustrate a side view, respectively, and end view of an attachment which may be utilized for projecting BBs or other projectiles. The attachement comprises a barrel member 23 extending from a U-shaped connection member 24 with the barrel and connection member being provided with a nozzle or channel 25 extending therethrough. The so-called BB attachment may be constructed of plastic, metal or any other suitable material with the size of the nozzle 25 depending upon the application and on the size of the projectiles (pellets, BB, air darts, blow gun darts, etc.) to be utilized. To attach the attachment to the cylinder 1, the legs of the connection member 24 are squeezed together so as to enable insertion thereof into the channel 3 of the plug 2. In this position, a BB or air dart may be inserted into the rear end of the barrel 23, i.e., at the connection member end 24 and thereafter the connection member end is pushed downwardly so as to align the nozzle or channel 25 with the orifice 4. When the archer draws back, aims and releases the arrow-like shaft 6, the compressed air expelled through the orifice 4 will cause the BB or other object in the nozzle 25 to be expelled from the barrel and projected outwardly toward a target or the like. Since the piston-cylinder arrangement operates as a shot absorbing mechanism, the propelling distance of the object is effectively limited to several meters although care must be taken to avoid injury as in the case of any air operated gun or the like.

Figure 7:
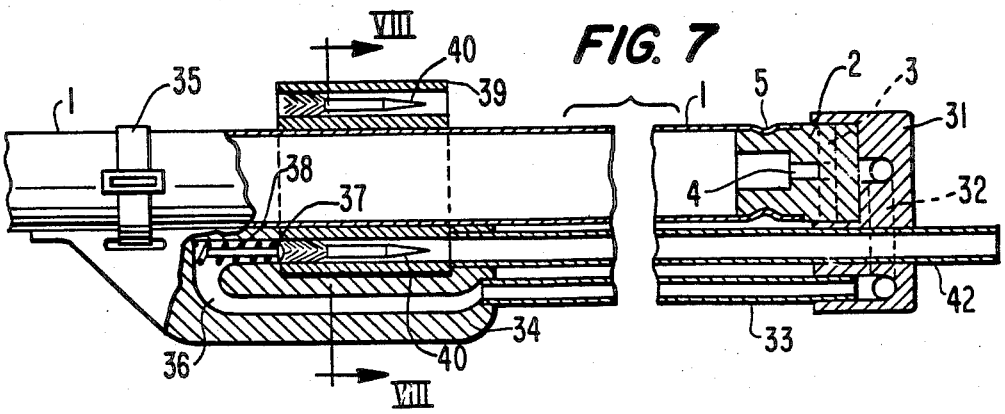
FIG. 7 is a partial sectional view of a projectile attachment for the practice/exercise device.
Figure 8:
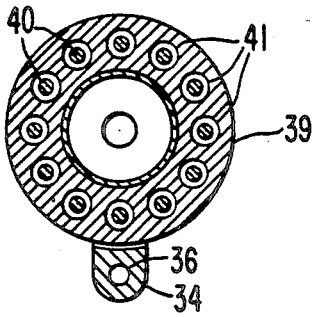
FIG. 8 is a cross-sectional view taken along plane VIII—VIII of FIG. 7.

FIG. 7 illustrates a different type of attachment device for propelling air darts or the like and includes an attachment member 31 which is secured to the plug 2 by way of the indentations 3. The member 31 is provided with a channel 32 which aligns with the orifice 4 and acts as an extension thereof. The channel 32 is approximately U-shaped with the other end of the channel 32 being coupled with a pipe member 33 having one end received within the channel in the attachment member 31. The pipe 33 may be constructed from any type of material such as aluminum, plastic, copper or the like. The other end of pipe 33 is connected to a cylinder holder 34 which attaches to the cylinder 1 by way of a tie wrap 35 or the suitable attaching mechanism. The cylinder holder 34 which may be constructed from any suitable material such as metal, plastic or the like, is provided with an air passage 36, one end of which is in communication with the end of pipe 33 and the other end of which is provided with an air lock pipe 37. The air lock pipe 37 is maintained in place by an expansion spring 38 which biases the air lock pipe 37 toward the surface of a revolver cylinder 39 which carries nesting holes 41. The nesting holes 41 are more clearly seen in FIG. 8 which is a cross-sectional view of the cylinder holder 34 and the revolver cylinder in relation to the cylinder 1 taken along the line VIII of VIII of FIG. 7. Air darts 40 are disposed in the nesting holes 41 and upon drawing and release of the arrow-like shaft 6, the piston 9 forces air through the orifice 4 into the channel 32, through the pipe 33 and into air passage 36 through the air lock pipe 37 so as to push air dart 40 from the nesting hole 41 aligned with the air channel 36 and into the nozzle pipe 42 aligned with such nesting hole. Upon successive shooting of the bow, the archer must manually advance the revolver cylinder 39 so that another air dart can be aligned with the nozzle pipe 42 and the air passage 36 so that such air dart can be projected. As is apparent, the revolver cylinder 39 and cylinder holder 35 and other mechanisms are slidably mounted from the front end of the cylinder 1 onto the cylinder to the point where the attachment member 31 couples with the plug 2 in the manner illustrated.

Figure 10:
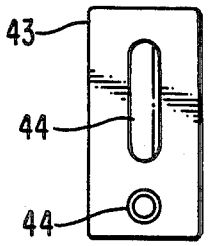
FIG. 10 is an end view of the attachment of FIG. 9.
Figure 9:
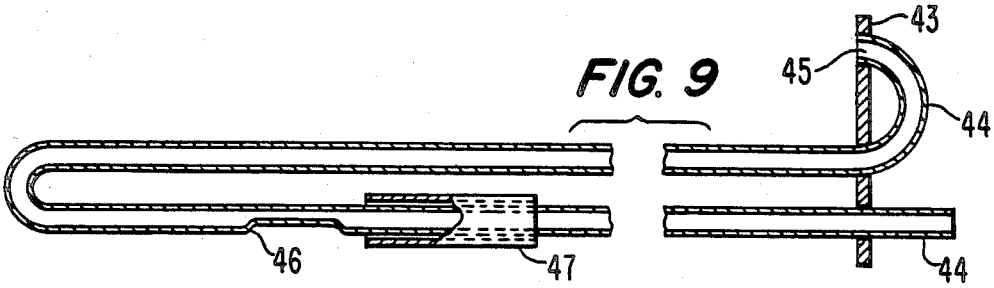
FIG. 9 illustrates an air dart attachment for the practice/exercise device.

FIG. 9 illustrates another type of air dart attachment which may be constructed from any suitable material, such as copper, aluminum, plastic or the like and includes an attaching plate 43 for coupling with the member 3 of the plug 2 of the cylinder 1. The plate 43 is provided with a pipe 44 having a form as illustrated wherein the entrance opening 45 of the pipe 44 is adapted to be aligned with the orifice 4 of the plug 2. Thus, the pipe 44 acts as an extension of the orifice 4 and permits air to travel through the pipe 44 in accordance with the movement of the piston 9 within the cylinder 1. The pipe 44 includes a first arcuate U-shaped portion extending from the opening 45 and terminating in a first linear portion extending in the rearward direction which in turn terminates in a second arcuate U-shaped portion. The second arcuate portion terminates in a second linear portion extending in the forward direction. The second linear portion of pipe 44 is provided with a cut-out or opening 46 through which an air dart or other suitable projectile is loaded in the pipe 44. The opening 46 is then closed by means of an overlying pipe section 47 slidably mounted on the pipe 44. The pipe 47 may be provided with spiral indentations for easy hand operation and, upon loading of an air dart through the opening 46, the pipe section 47 is slid over the opening hole 46 so as effectively seal the opening 46 so that upon drawing and release of the arrow-like shaft 6, air expelled from the orifice 4 will travel through the pipe 44 and propel the air dart from such pipe. FIG. 10 illustrates an end view of the attachment device of FIG. 9.

Figure 11:
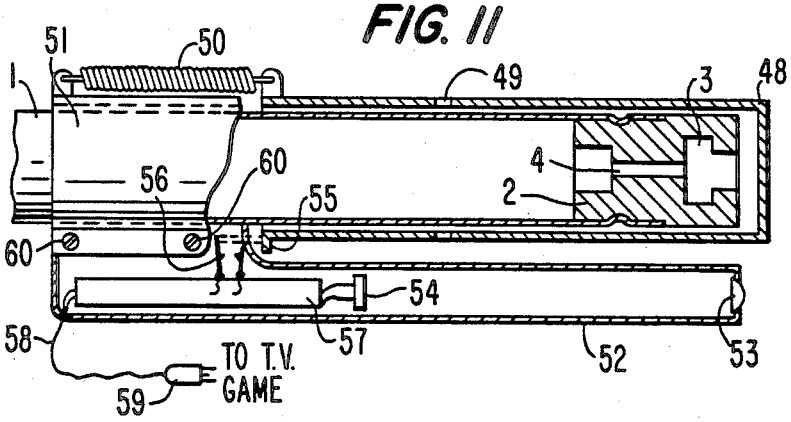
FIG. 11 is a partial sectional view of a TV game attachment for the practice/exercise. device.
Figure 12:
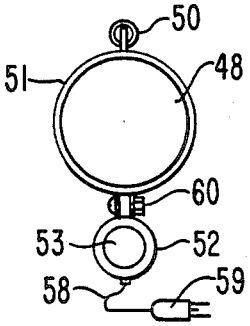
FIG. 12 is an end view of the TV game attachment of FIG. 11.

FIG. 11 illustrates a T.V. game attachment which includes a cylinder 48 closed at the forward end and overlying the cylinder 1. The cylinder 48 is maintained in position by a spring 50 attached to an attachment collar 51 which is secured to the cylinder 1 by a suitable fastening device such as screws 50. A cylindrical extension 52 is permanently secured to the attachment collar 51 and at its forward end is provided with an opening in which is disposed a focusing lens 53. A photocell such as a phototransistor 54 which is electrically connected with an electronic component plate 57 is disposed within the cylindrical extension 52 and positioned at a point so as to receive light focused by the focusing lens 53. A portion of the electronic component plate 57 includes a normally closed switch 56, which in the rest position illustrated, is maintained in an open position by an extension 55 of the cylinder 48. That is, with the cylinder 48 being biased by the spring 50 to the position illustrated, the extension 55 abuts against one of the switch contacts of the switch 56 so as to maintain the normally closed switch in the open position. The electronic component plate 57 is connected via a cord 58 and a plug 59 to a T.V. game board which includes a shooting game software as is known in the art. In accordance with such shooting game software, a light dot randomly travels over the T.V. screen and by aligning the randomly travelling dot with the phototransistor 54, through the lens 53 and closing the switch 56, the phototransistor 54 will receive a light signal and provide an output signal indicative thereof. The output signal is processed by the electronics of board 57 and via the cord 58 and plug 59, the signal is transferred to the T.V. game board for further processing and recording of the score which normally appears on the television screen along with the sound effects provided by the software of the T.V. shooting game. Thus, the archer draws the arrow-like shaft 6 and follows the light dot on the T.V. screen until an alignment of the light dot and the phototransistor 54 is achieved in accordance with his estimate and skills and thereafter releases the arrow-like shaft 6. As discussed above, the piston 9 is driven forwardly in the cylinder 1 and air from cylinder 1 is forced through orifice 4 which air pushes cylinder 48 outwardly away from cylinder 1 against the force of the spring 50 until the relief holes 49 in the cylinder 48 relieve the pressure inside cylinder 48. With a forward movement of cylinder 48, the extension 55 thereof also moves in the forward direction so that this extension no longer keeps the contacts of switch 56 from assuming the normally closed position so that such switch closes. Upon closing of the switch 56, the light signal from the light dot on the T.V. screen which is focused by the focusing lens 53 on the phototransistor 54 is received by the phototransistor which provides an output signal which is processed as described above. Upon release of the air pressure through the holes 49 in the cylinder 48, the cylinder 48 returns to its original position under the force of spring 50 and the extension 55 again opens the contacts of switch 56. FIG. 12 illustrates an end view of the embodiment of FIG. 11.

Figure 13:
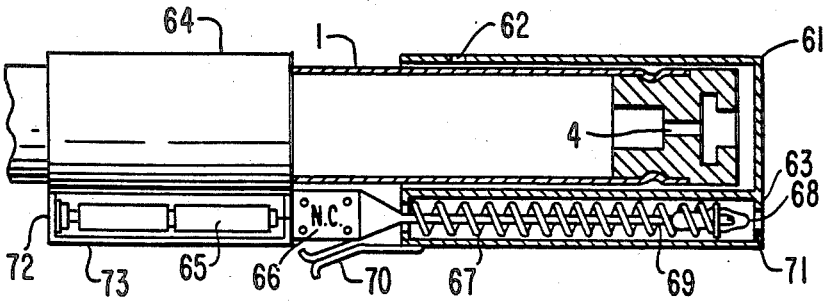
FIG. 13 is a partial sectional view of a photo-target attachment for the practice/exercise device.
Figure 14:
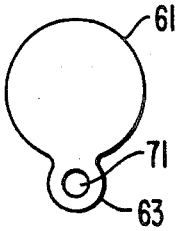
FIG. 14 is an end view of the photo-target attachment of FIG. 13.
Figure 15:
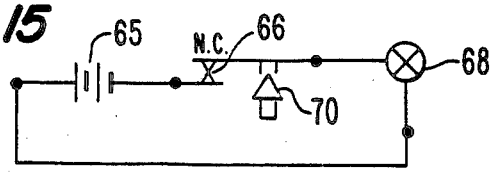
FIG. 15 is an electrical circuit diagram of the circuit utilized in connection with the photo-target attachment.

FIG. 13 illustrates another photo-target attachment for the cylinder which is utilized with a specialized target and electronic circuit. As shown in FIG. 13, the attachment includes a cylinder 61 closed at one end. The cylinder 61 overlies cylinder 1 and is mounted for sliding movement with respect thereto. A cylinder 63 is attached to the cylinder 61 and both cylinders 61 and 63 may be manufactured from metal, plastic or any other suitable material. Cylinder 63 is provided with an aperture opening 71 through which the light of an electric bulb 68 may be projected. The bulb 68 and its electrically conductive extension 69 is disposed within the cylinder 63 and the bulb is electrically connected to a normally closed switch 66 via the extension 69, the switch 66 being attached to an attachment collar 64 which is securely fastened on the cylinder 1 by any suitable fastening mechanism. The attachment collar 64 carries a battery housing 73 in which batteries 65 are disposed and are maintained in contact with switch 66 by way of a tension spring 72. The cylinder 63 is provided with an extension arm 70 which through the force of tension spring 67 maintains a contact of the normally closed switch 66 in the open position so that in the rest position of the attachment as illustrated in FIG. 13, the contact of the switch 66 is biased in the open position and the switch 66 is in the open position. Cylinder 61 is provided with air relief holes 62 in a manner corresponding to the air relief holes 49 in FIG. 11. FIG. 14 illustrates an end view of the embodiment of FIG. 13, and FIG. 15 illustrates the circuit arrangement of the batteries 65, normally closed switch 66 and the extension 70 together with the bulb 68.

In operation, the archer draws the arrow-like shaft 6 out of the cylinder 1 and upon release of the arrow-like shaft, the piston 9 is driven forwardly in the cylinder 1 so that air is forced outwardly through orifice 4 and causes the cylinder 61 to move outwardly in the forward direction with an accompanying movement of the cylinder 63. During this outward or forward movement, due to the air pressure within cylinder 61, the arm 70 moves in the forward direction and releases the switch contact of switch 66 so that this switch contact is permitted to achieve the normally closed position of switch 66 thereby completing the circuit from the battery to the light bulb 68 resulting in lighting of such bulb. The light of bulb 68 is projected through aperture 71 and casts a light spot on the target illustrated in FIG. 16. During the outward or forward movement of the cylinders 61 and 63, the light spot projected onto the target of FIG. 16 appears to vary in diameter with time and becomes smaller from its initial large light spot to a smaller light spot and then again increases in diameter as shown by the curve of FIG. 17. That is, the light spot reduces in diameter and appears to shrink until the air relief holes 62 come into position to relieve the air pressure within cylinder 61. At such time, the light spot on the target attains its minimum diameter. Due to absence of air pressure within cylinder 61, or the reduction thereof, the depressed spring 67 forces cylinders 61 and 63 back to their initial rest position. During this movement, the light spot through aperture 71 enlarges and reaches its maximum diameter at the time the arm 70 again causes the contact arm of switch 66 to open thereby interrupting the circuit to the light bulb 68 such that the light bulb is turned off. FIG. 17 illustrates the time variation in the light spot diameter with point 85 representing the initial maximum diameter at the time the light bulb 68 is turned on, point 86 represents the minimum diameter at which time the air pressure within the cylinder 61 is relieved and the cylinder 61 and the accompanying cylinder 63 attain the maximum forward or outward position with respect to the cylinder 1, and point 87 represents the cylinders 61 and 63 attaining the position immediately prior to arm 70 opening the switch 66 at which time the light bulb 68 is turned off as represented by point 88.

Figure 16:
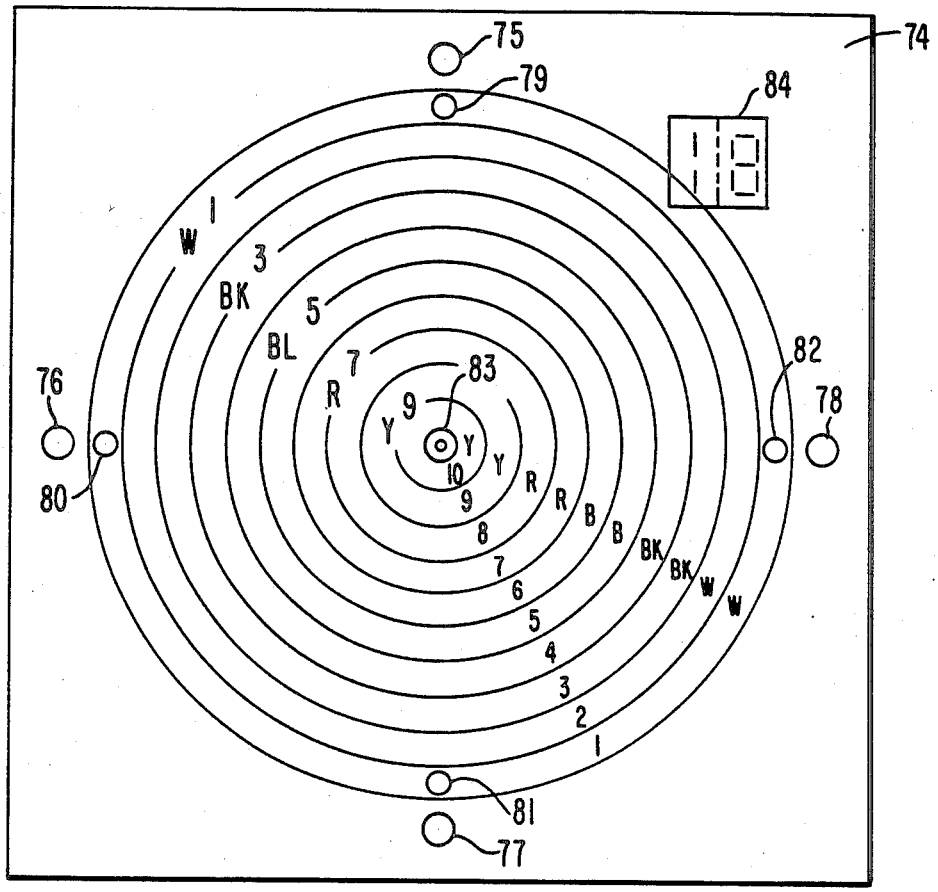
FIG. 16 illustrates an electronic target for utilization with the photo-target attachment.
Figure 17:
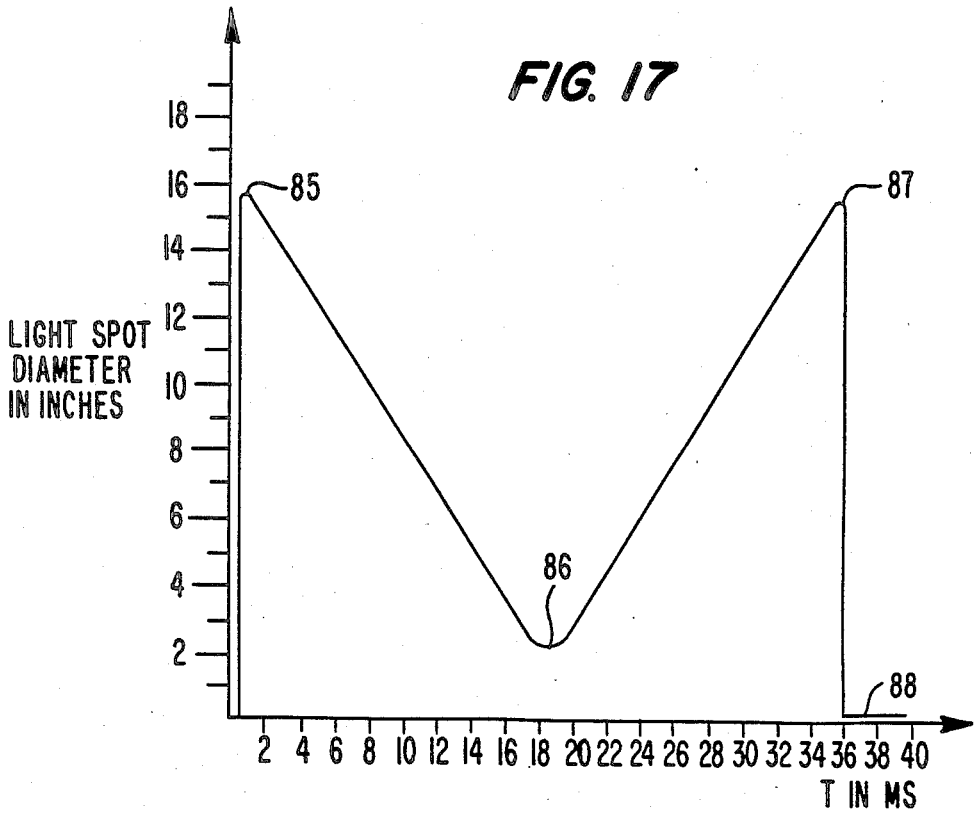
FIG. 17 illustrates a timing diagram of the light aperture of the photo-target attachment.

FIG. 16 is a front view of an electronic target utilized with the attachment of FIG. 13. This target includes a front surface 74 provided with ten concentric circles having the traditional coloring. That is, the two centermost circles are colored yellow and score 9 points, the next two circles are colored red and score as 7 points, the next two circles are colored blue and score as 5 points, the next two circles are colored black and score as 3 points, and the two outermost circles are colored white and score as 1 point. This target and the scoring is known as "Prince's Reckoning" 9 point scoring system, but it is apparent that the surface 74 can be provided with various arrangements so as to accommodate the "International Championship" scoring system which counts as 1 point for each successive circle starting with 10 points for the innermost circle (bulls-eye) and decreasing by 1 point per circle to one on the outermost circle. Additionally, other scoring systems may be devised to suit the needs of the user. The surface 74 is also provided with a plurality of openings to permit light from LED's or lights 75, 76, 77 and 78 positioned in the opening or behind the opening to show therethrough. Further, the surface 74 also is provided with openings in which photocells 79, 80, 81, 82 and 83 are disposed or placed with respect thereto so as to permit light from the lightbulb 68 to be received thereby. The aforementioned openings in the surface 74 of the target are placed to accommodate the LEDs or lights and photocells so that an indication of the direction of the shot can be obtained. Additionally, the surface 74 may be provided with another opening 84 through which a read-out display indicative of the scoring attained by the archer may be provided.

The target of FIG. 16 is placed at a suitable distance in front of the archer so that the maximum diameter of the light spot generated by the bulb 68 in the most forward position of the cylinders 61 and 63 strikes the surface 74 and is equal to the outermost circle of the target in which outermost circle the light responsive photocells 79, 80, 81 and 82 are disposed. Furthermore, the photocell 83 is disposed at the centermost position of the circles or the bulls-eye whereby upon the light spot striking the surface 74, the photocells 79, 80, 81, 82 and 83 may separately receive the light and separately or collectively provide signals for the scoring mechanism.

Figure 18:
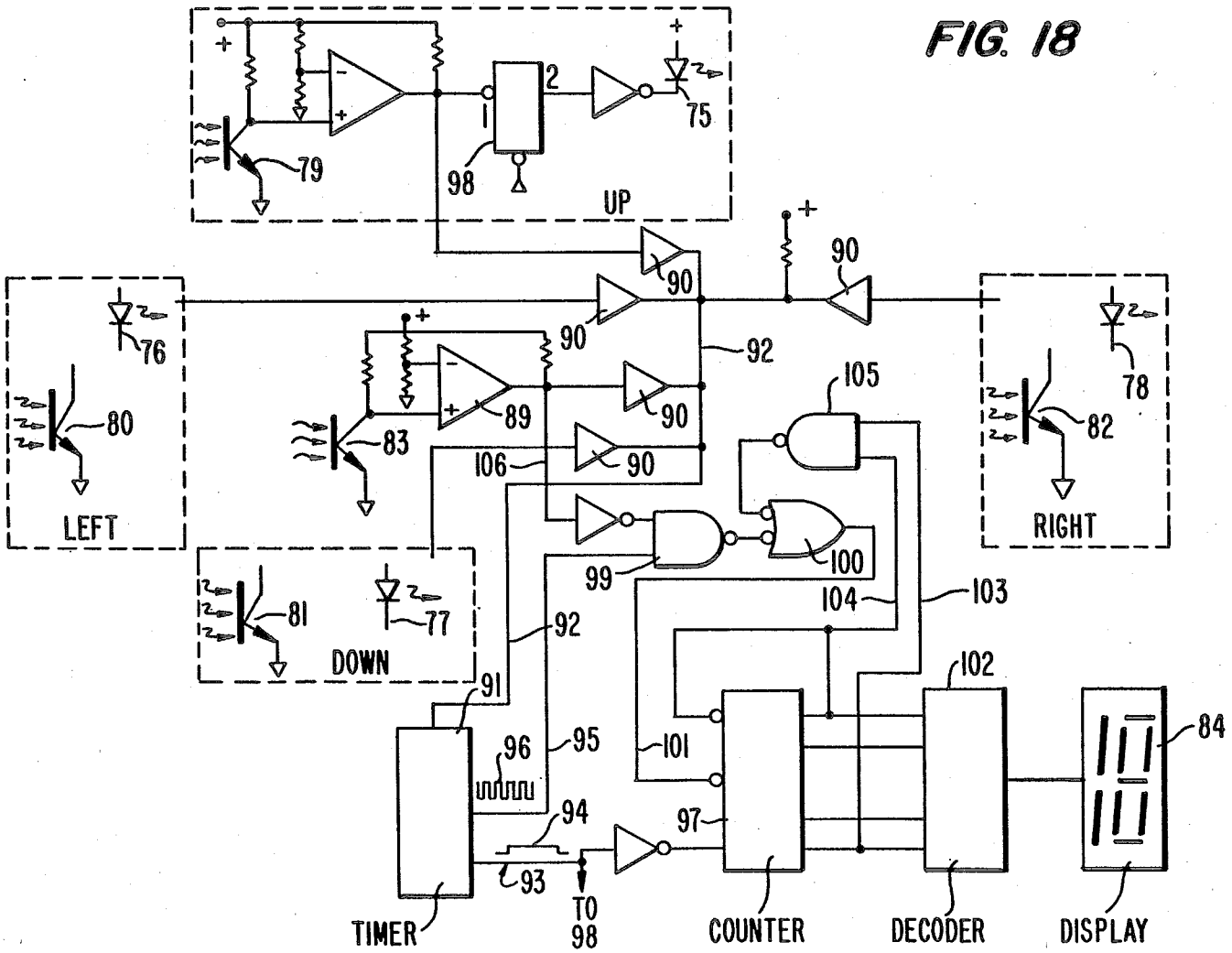
FIG. 18 illustrates in block diagram form an electrical circuit of the electronic target.

FIG. 18 is a schematic block diagram representation of the electronic circuit for the scoring associated with the target. For simplification purposes, the circuit for the photocell 79 in the form of a phototransistor and the LED positioned at the top of the target is illustrated with the photocell 80 and its associated LED 76 as well as the photocells 81 and the associated LED 77, and photocell 82 and associated LED 78 positioned at the left, bottom and right side portions of the target as illustrated in FIG. 16 are shown schematically in blocks. In operation, upon the light spot generated by the lightbulb 68 striking the surface 74 and impinging on the photocells 79, 80, 81, 82 or 83, such photocells separately or collectively trigger through an associated operation amplifier 89 and driver amplifier 90 to provide a signal on line 92 which is delivered to a dual timer 91. The dual timer 91 has one portion which operates as an astable multi-vibrator for producing square wave pulses 96 on output line 95 to NAND gate 99. The other portion of the dual timer 99 operates as a monostable multi-vibrator and produces a single pulse 94 on output line 93. Pulse 94 is delivered to the counter 97 for enabling the counter to initiate counting, the counter 97 being a decade counter. The pulse 94 is also delivered to a respective flip-flop or latch circuit 98 for enabling the same. Accordingly, when a respective photocell 79, 80, 81 or 82 receives light from the light spot, thereby generating a signal through the associated operational amplifier 89, such signal is also delivered to the associated latch 98 which, upon becoming enabled by the pulse 94 provides an output for energizing the respective associated LED 75, 76, 77 or 78 so as to light the same and to indicate that the associated photocell has received light from the light spot. The center photocell 83 in response to light from bulb 68, provides an output via line 106 to the NAND gate 99 for enabling the same. Thus, the pulses 96 pass through gate 99 and NAND gate 100 via line 101 to the input of counter 97 which counts the pulses as long as the center photocell 83 is excited by the light. The counter 97 provides an output to the decoder 102 which decoder in turn provides an output for energizing the read-out display 84. The read-out 84 and the LEDs whose respective photocells have been excited remain on for the archer to review his score and the direction of his shot in accordance with the lighting of the LEDs for a time period determined by the length of the pulse 94. That is, when the pulse 94 no longer appears on line 93, the respective latches or flip-flops 98 are reset and the LEDs are turned off. Additionally, the counter 97 is also reset when the pulse 94 no longer appears on line 93 and, in turn, the read-out 84 is turned off.

As shown in FIG. 18, in order to provide a counting up to 9 (Prince's Recognizing System), a NAND gate 105 is connected to receive outputs from the counter 97 via lines 103 and 104 and the output of gate 105 is supplied to the NAND gate 100 so as to cause the counter 97 to count to 9. Since the counter 97 counts as long as the light is present at the photocell 83 and because such time has been synchronized for the counter to reach its maximum counting, the light spot from the bulb 68 is required to be present at the central photocell during the entire shot duration. Additionally, for the counter to count to 9 as displayed by the read-out 84, all of the outer or peripheral photocells 79, 80, 81 and 82 must also receive some light and all of the associated LEDs will be lighted. The lighting and the score will indicate that the archer has achieved a shot in the center of the target. If the shot is not in the center, the central photocell 83 will receive light for a lesser time and the counter 97 will count an amount smaller than 9 depending on the distance of the shot from the center. The direction of the shot will be determined by the lighting of one or more of the LEDs that the archer can correct his aiming. As is apparent, the light spot diameter variation mechanism of FIG. 13 may be replaced with a light iris so as to provide the variable light spot diameter and, additionally, the attachment arrangement of FIG. 13 may be altered to fit other shooting type devices other than the archery exercise/practice device disclosed herein. That is, the arrangement of FIG. 13 may be suitably altered to fit another shooting device such as air guns, firearms using blanks, or the like, Also, it is apparent that a score accumulator can be utilized in the circuit arrangement so that additionally a total score would appear in a separate read-out located, for example, on the surface of the target.

With the present invention, an archer can practice or exercise archery without releasing a real arrow and in a safe manner while at the same time developing all the necessary skills and muscles utilized in archery. Furthermore, with the attachments provided, projectiles of different types may be fired over small distances toward targets which, again, can be accomplished with relative safety. Also, the photo-target arrangement as disclosed herein may be utilized with other types of shooting devices.

While I have shown and described several emodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

What is claimed is:

1. An archery practice/exercise device for detachable connection with a bow including a handleriser and a bow string for shooting regular arrows without connection of the arching practice/exercise device thereto, the device comprising a cylinder, means for partially closing a forward end of the cylinder so as to delimit an orifice thereat through which air may be expelled from the cylinder, a piston mounted for movement within the cylinder, an arrow-like shaft having a forward end coupled to the piston and extending outwardly from a rear end of the cylinder, a closure mens provided at the rear end of the cylinder for permitting the arrow-like shaft to pass therethrough and for supporting the arrow-like shaft, the arrow-like shaft being provide with a nock at the rear end for coupling with a bow string, means for enabling a detachable connection of the cylinder from the handleriser of the bow, the connection means being disposed to the rear end of the cylinder and secured thereto for enabling rigid attachment of the cylinder to the handleriser of the bow whereupon attachment to the handleriser, the cylinder extends forwardly of the handleriser for stabilizing the bow, whereby upon an archer coupling the nock to the bow string and drawing the arrow-like shaft out of the cylinder to a desired length, the piston is caused to move from an initial forward position to a rearward position within the cylinder, and upon the archer releasing the arrow-like shaft from the drawn-out position, the piston is driven forwardly compressing air with the cylinder and forcing the air out of the orifice so that a substantial portion of the energy of the bow is absorbed by the cylinder, thereby enabling the archer to exercise and practice archery skills in a safe manner with the bow without the shooting of a regular arrow, and further comprising an air responsive attachment device for use with a T.V. game system in which a light dot randomly travels over a T.V. screen and it is desired to aim and shoot at the light dot, the air responsive attachment device including a coupling member for being coupled to the cylinder,, the coupling member including a tubular housing spaced from the cylinder and extending in a direction parallel to the longitudinal direction of the cylinder, the tubular housing having a focusing lens disposed in a forward opening thereof, a photocell arranged within the tubular housing for receiving light focused by the focusing lens, the photocell being coupled to a circuit means connected to the T.V. game system, the circuit means including switch means having normally closed contacts for completing a circuit for permitting the photocell to provide an output in response to light received thereby, a tubular member having a closed forward end adapted to be mounted in overlying relation with respect to the cylinder for sliding movement with respect to the forward end of the cylinder, biasing means for coupling the coupling member and the tubular member and for biasing the tubular member toward the coupling member in the rearward direction of the cylinder, the tubular member including a projection for contacting one of the contacts of the switch means so as to maintain the normally closed contacts in an open position in an initial rest position of the tubular member, whereby upon drawing and releasing of the arrow-like shaft when the focusing lens is aligned with the randomly travelling light dot on the T.V. screen, air is forced out of the orifice causing the tubular member to overcome the force of the biasing means so that the projection of the tubular member moves away from the one contact of the switching means enabling the contacts of the switching means to close and complete the circuit with the photocell being responsive to the light of the light dot on the screen focused thereon by the focusing lens for generating an output signal via the circuit means to the T.V. game system during the forward movement of the tubular member.

2. An archery practice/exercise device according to claim 1, wherein the tubular member is provided with a plurality of apertures at a predetermined position therealong, the apertures enabling air in the space between the cylinder and the tubular member to be relieved therethrough during the forward movement of the tubular member whereby the force of the biasing means becomes effective to return the tubular member to the initial rest position.

3. An archery practice/exercise device for detachable connection with a bow including a handleriser and a bow string for shooting regular arrows without connection of the arching practice/exercise device thereto, the device comprising a cylinder, means for partially closing a forward end of the cylinder so as to delimit an orifice thereat through which air may be expelled from the cylinder, a piston mounted for movement within the cylinder, an arrow-like shaft having a forward end coupled to the piston and extending outwardly from a rear end of the cylinder, a closure mens provided at the rear end of the cylinder for permitting the arrow-like shaft to pass therethrough and for supporting the arrow-like shaft, the arrow-like shaft being provided with a nock at the rear end for coupling with a bow string, means for enabling a detachable connection of the cylinder from the handleriser of the bow, the connection means being disposed to the rear end of the cylinder and secured thereto for enabling rigid attachment of the cylinder to the handleriser of the bow whereupon attachment to the handleriser, the cylinder extends forwardly of the handleriser for stabilizing the bow, whereby upon an archer coupling the nock to the bow string and drawing the arrow-like out of the cylinder to a desired length, the piston is caused to move from an initial forward position to a rearward position within the cylinder, and upon the archer releasing the arrow-like shaft from the drawn-out position, the piston is driven forwardly compressing air with the cylinder and forcing the air out of the orifice so that a substantial portion of the energy of the bow is absorbed by the cylinder, thereby enabling the archer to exercise and practice archery skills in a safe manner with the bow without the shooting of a regular arrow, and further comprising an air responsive attachment device for use with a target, the air responsive attachment device comprising a coupling member for coupling to the cylinder, the coupling member having a housing for battery means, the battery means being connected to a switch means having normally closed contacts, a pair of connected parallel extending cylinder members, one of the pair of cylinder members having a closed forward end and adapted to be mounted in overlying relation with respect to the cylinder for sliding movement with respect to the forward end of the cylinder, the other of the pair of cylinder members housing a light emitting means electrically connected to the switch means by an extension member, the other cylinder member having an aperture at the forward end through which light of the light emitting means is projected and at the rear end thereof a projection arranged for contacting one of the contacts of the switch means so as to maintain the normally closed contacts in an open position, and biasing means for biasing the other of the cylinder members into rest position where the projection maintains the contacts of the switch means in an open positions so that a circuit of the battery means to the light emitting means is not completed and the light emitting means is not energized, whereby upon drawing and releasing of the arrow-like shaft, air is forced out of the orifice causing the one cylinder member and the other cylinder member to move in the forward direction overcoming the force of the biasing means so that the projection of the other cylinder member moves away from the one contact of the switching means enabling the contacts of the switching to close and complete the circuit with the light emitting means becoming energized and projecting a beam of light through the aperture which appears as a light spot on the target.

4. An archery practice/exercise device according to claim 3, wherein the other cylinder member is movable with respect to the light emitting means so that the diameter of the light spot on the target varies with the position of the other cylinder member, the one cylinder member being provided with a plurality of apertures at a predetermined position therealong, the apertures enabling air in the space between the cylinder and the one cylinder member to be relieved therethrough during the forward movement of the one cylinder member and the other cylinder member therewith, whereby the force of the biasing means becomes effective to return the pair of cylinder members to the rest position so that the projection again contacts the one contact of the switching means to open the switching means and deenergize the light emitting means, the diameter of the light spot on the target varying between a maximum diameter at a position of the other cylinder member proximate to the rest position and a minimum diameter at the most forward position of the other cylinder member.

5. An archery practice/exercise device according to claim 4, wherein the target is a light responsive target and includes means responsive to the light spot impinging thereon for providing an indication thereof.

6. An archery practice/exercise device according to claim 5, wherein the light responsive target includes a surface provided with a predetermined target pattern, the surface having a first plurality of openings at predetermined positions within the target pattern, the light responsive means including a plurality of photocells, a respective photocell being positioned in a respective one of the first plurality of openings and being responsive to light of the light spot impinging thereon for providing an output signal, and indicating means responsive to the output signal for providing an indication thereof.

7. An archery practice/exercise device according to claim 6, wherein the target surface is provided with a second plurality of openings at predetermined positions thereon, and the indicating means includes light emitting means being positioned in respective ones of the second plurality of openings, respective ones of the light emitting means being associated with respective ones of the photocells and responsive to the output signal of the associated photocell for providing a light output indicative thereof.

8. An archery practice/exercise device according to claim 7, wherein one of the photocells is positioned at the center of the target pattern and the others of the photocells are positioned along the outermost portion of the target pattern at positions spaced from one another and adapted to receive light of the light spot at the maximum diameter thereof when the light spot is centered on the target pattern, a respective light emitting means being associated with a respective one of the other of the photocells, the indicator means further including timer means responsive to an output signal of at least one of the photocells for generating a first output signal for a predetermined period of time and a second output signal, counting means responsive to the first output signal for being enabled, gating means responsive to the second output signal and an output signal of the center photocell for providing an output to the counting means for counting thereof the counting means providing an output indicative of the count thereof, means including display means responsive to the counting means for displaying the count as an indication of the accuracy of the impingement of the light spot on the target, and means associated with the respective light emitting means for enabling the light emitting means in response to the first output signal of the timing means so that the light emitting means becomes energized in response to the output signal of the associated other photocell to provide an indication of the impingement direction of the light spot.

9. An air responsive attachement device and target for use with a cylinder having an orifice at a forward end thereof through which air is forced out from the cylinder, the air responsive attachment device comprising a coupling member for coupling to the cylinder, the coupling member having a housing for battery means, the battery means being connected to a switch means having of closed contacts, a pair of connected parallel extending cylinder members, one of the pair of cylinder members having a closed forward end and adapted to be mounted in overlying relation with respect to the cylinder for sliding movement with respect to the forward end of the cylinder, the other of the pair of cylinder members housing a light emitting means electrically connected to the switch means by an extension member, the other cylinder member having an aperture at the forward end through which light of the light emitting means is projected and at the rear end thereof a projection arranged for contacting one of the contacts of the switch means so as to maintain the normally closed contacts in an open position, and biasing means for biasing the other of the cylinder members into a rest position where the projection maintains the contacts of the switch means in the open position so that a circuit of the battery means to the light emitting means is not completed and the light emitting means is not energized, whereby upon air being forced out of the orifice the one cylinder member and the other cylinder member are caused to move in the forward direction overcoming the force of the biasing means so that the projection of the other cylinder member moves away from the one contact of the switching means enabling the contacts of the switching to close and complete the circuit with the light emitting means becoming energized and projecting a beam of light through the aperture which appears as a light spot on the target.

10. An air responsive attachment device and target according to claim 9, wherein the other cylinder member is movable with respect to the light emitting means so that the diameter of the light spot on the target varies with the position of the other cylinder member, the one cylinder member being provided with a plurality of apertures at a predetermined position therealong, the apertures enabling air in the space between the cylinder and the one cylinder member to be relieved therethrough during the forward movement of the one cylinder member and the other cylinder member therewith whereby the force of the biasing means becomes effective to return the pair of cylinder members to the rest position so that the projection again contacts the one contact of the switching means to open the switching means and deenergize the light emitting means, the diameter of the light spot on the target varying between a maximum diameter at a position of the other cylinder member proximate to the rest position and a minimum diameter at the most forward position of the other cylinder member.

11. An air responsive attachment device and target according to claim 10, wherein the target is a light responsive target and includes means responsive to the light spot impinging thereon for providing an indication thereof.

12. An air responsive attachment device and target according to claim 11, wherein the light responsive target includes a surface provided with a predetermined target pattern, the surface having a first plurality of openings at predetermined positions within the target pattern, the light responsive means including a plurality of photocells, a respective photocell being positioned in a respective one of the first plurality of openings and being responsive to light of the light spot impinging thereon for providing an output signal, and indicating means responsive to the output signal for providing an indication thereof.

13. An air responsive attachment device and target according to claim 12, wherein the target surface is provided with a second plurality of openings at predetermined positions thereon, and the indicating means includes light emitting means being positioned in respective ones of the second plurality of openings, respective ones of the light emitting means being associated with respective ones of the photocell and responsive to the output signal of the associated photocell for providing a light output indicative thereof.

14. An air responsive attachment device and target according to claim 13, wherein one of the photocells is positioned at the center of the target pattern and the others of the photocells are positioned along the outermost portion of the target pattern at positions spaced from one another and adapted to receive light of the light spot at the maximum diameter thereof when the light spot is entered on the target pattern, a respective light emitting means being associated with a respective one of the others of the photocells, the indicator means further including timer means responsive to an output signal of at least one of the photocells for generating a first output signal for a predetermined period of time and a second output signal, counting means responsive to the first output signal for being enabled, gating means responsive to the second output signal and an output signal of the center photocell for providing an output to the means counting for counting thereof, the counting means providing an output indicative of the count thereof, means including display means responsive to the counting means for displaying the count as an indication of the accuracy of the impingement of the light spot on the target, and means associated with the respective light emitting means for enabling the light emitting means in response to the first output signal of the timing means so that the light emitting means becomes energized in response to the output signal of the associated other photocell to provide an indication of the impingement direction of the light spot.

* * * * *